US007147500B2

(12) United States Patent
Tabata et al.

(10) Patent No.: US 7,147,500 B2
(45) Date of Patent: Dec. 12, 2006

(54) RESILIENT PLUG

(75) Inventors: Masaaki Tabata, Yokkaichi (JP); Tomohiko Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/922,616

(22) Filed: Aug. 19, 2004

(65) Prior Publication Data

US 2005/0042906 A1 Feb. 24, 2005

(30) Foreign Application Priority Data

Aug. 20, 2003 (JP) ..... 2003-295851

(51) Int. Cl.
*H01R 13/28* (2006.01)

(52) U.S. Cl. ..... 439/274; 174/74 R

(58) Field of Classification Search ..... 439/274, 439/279, 587, 275, 588–589, 523, 730, 867, 439/595, 594, 717, 701, 271, 273, 272, 278, 439/282, 190, 586; 277/612, 355, 615, 357, 277/205, 207, 212, 168, 101, 207 R, 607, 277/626, 627, 648; 174/153 G, 152 G, 65 G, 174/65 R, 74 R, 74 A, 84 C, 77 R, 75 F
See application file for complete search history.

(56) References Cited

U.S. PATENT DOCUMENTS 4,643,506 A * 2/1987 Kobler ..... 439/271
5,540,450 A * 7/1996 Hayashi et al. ..... 277/607
5,562,494 A * 10/1996 Fujiwara ..... 439/587
6,036,541 A * 3/2000 Koumatsu ..... 439/587
6,101,674 A * 8/2000 Furuya et al. ..... 16/2.1

FOREIGN PATENT DOCUMENTS

JP 2002-203636 7/2002
JP 2003-45552 2/2003

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

A rubber plug (10) has a main body (11) with opposite front and rear ends. A wire insertion hole (12) extends through the main body (11) from the rear end to the front end and has a wire-introducing opening (14) at the rear end. A forwardly and inwardly tapered portion (18) is formed on the outer circumferential surface of the main body (11) at the front end and a fastening portion (17) is rearward of the tapered portion (18). Protrusions (19) project radially out at the front end of the main body (11). The maximum outer diameter of the front end, including the protrusions (19), exceeds the inner diameter of the wire-introducing opening (14) at the rear end of the main body (11) and is no greater than the minimum outer diameter of the fastening portion (17).

14 Claims, 5 Drawing Sheets

RESILIENT PLUG

BACKGROUND OF THE INVENTION

1. Field of the Invention

The invention relates to a plug for a watertight connector.

2. Description of the Related Art

Japanese Unexamined Patent Publication No. 2002-203636 and FIG. 6 herein relate to a plug for a water tight connector. With reference to FIG. 6, a known rubber plug 9 is substantially cylindrical and a wire insertion hole 1 penetrates the rubber plug 9 along a longitudinal center. The plug 9 has a trunk 2, lips 3 and a fixing portion 4 arranged longitudinally in this order from the rear end to the front end. An insulation barrel (not shown) is crimped into connection with the fixing portion 4. Thus, the fixing portion 4 may be warped out at a portion before the crimped part. The terminal fitting (not shown) secured to the rubber plug 9 then is inserted into a cavity (not shown) of a connector housing. As a result, the warped portion may catch the inner wall of the cavity and may be turned up. To avoid this problem, the rubber plug 9 has a tapered small-diameter portion 5 before the crimped part. The small-diameter portion 5 will warp less and is less likely to catch the inner wall of the cavity.

The rubber plugs 9 are thrown into a bowl (not shown) of a parts feeder before wires are inserted into the wire insertion holes 1, and are conveyed in alignment in a specified direction by vibrating the bowl. However, the leading ends of the rubber plugs 9 are tapered. Thus, the leading end of the one rubber plug 9 may enter the wire insertion hole 1 of another rubber plug, and two rubber plugs 9 may be coupled together as shown in FIG. 6. This may hinder the conveyance in a proper alignment in the parts feeder.

The invention was developed in view of the above problem and an object thereof is to improve the operability of the resilient plugs in use.

SUMMARY OF THE INVENTION

The invention is a resilient plug with a main body that has opposite front and rear ends. A wire insertion hole penetrates the main body along a longitudinal center from the rear end to the front end. The wire insertion hole has a wire-introducing opening at the rear end of the main body for receiving a wire that can be inserted through the wire-introducing opening. The outer surface of the main body tapers to a narrower cross-section near the front end of the main body. However, at least one protrusion projects out at the front end of the main body. The maximum outer diameter at the front end, including the protrusion, exceeds the inner diameter of the wire-introducing opening.

The protrusion at the front end of each resilient plug can interfere with the opening edge of the wire insertion hole at the rear end of another resilient plug. Thus, no resilient plug can enter the wire insertion hole of another resilient plug, and the resilient plugs cannot be coupled together. Accordingly, a proper conveyance is assured, and operability is improved.

A fastening portion preferably is formed on the outer surface of the main body and can be fastened to an insulation barrel of a terminal fitting. More particularly, a wire can be inserted into the wire insertion hole and through the wire-introducing opening. The insulation barrel of the terminal fitting then can be crimped, bent or folded into connection with the fastening portion to hold the main body and the wire in a watertight manner.

Part of the resilient plug between the front end and the fastening portion may warp when the insulation barrel is crimped, bent or folded into connection with the fastening portion. However, the tapered front end reduces the degree of warping. Thus, the warped part is less likely to catch the inner wall of the cavity when the terminal fitting is inserted into the cavity of the housing, and the smooth insertion of the terminal fitting can be ensured.

Several protrusions preferably are provided at substantially even intervals about the circumference of the main body. Thus, the entire front end of the main body has a uniform resilient force, and there is no likelihood that part of the front end will undergo a large resilient deformation due to interference with the opening edge or inner wall of a cavity. Therefore, better insertion stability into the cavity can be attained.

The maximum outer diameter at the front end, including the protrusions, preferably does not exceed the minimum outer diameter of the fastening portion. Thus, the protrusions will not hinder insertion into the cavity even if the tapered portion is warped when the insulation barrel is crimped, bent or folded into connection with the fastening portion.

A radially outer surface of the protrusion(s) preferably is inclined less with respect to the longitudinal direction than the tapered portion.

The protrusion(s) preferably is/are provided in a portion of the main body corresponding to the taper.

The main body preferably is made of rubber, and most preferably silicon rubber.

The wire-introducing opening preferably converging inwardly.

The main body preferably has at least one outer lip and/or at least one inner lip.

These and other features and of the invention will become more apparent upon reading the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 1:
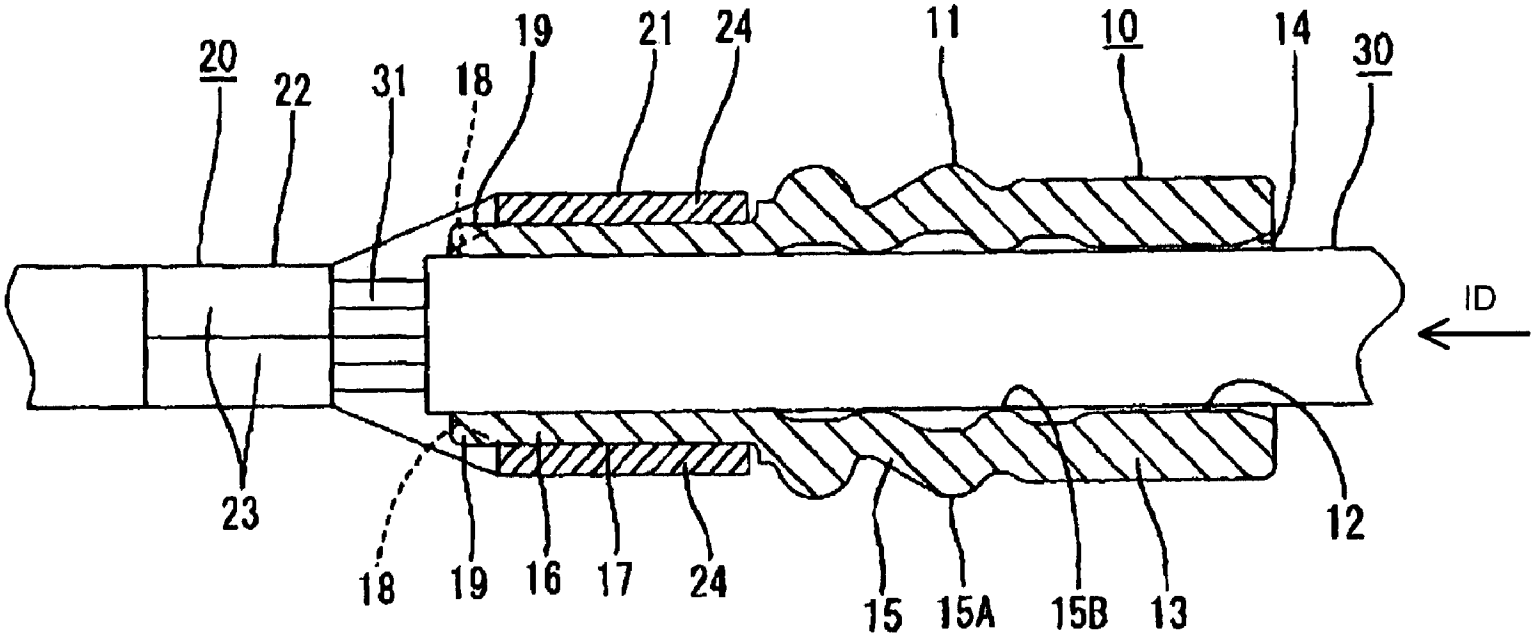
FIG. 1 is a section showing a rubber plug according to one embodiment of the invention, a terminal fitting and a wire.
Figure 2:
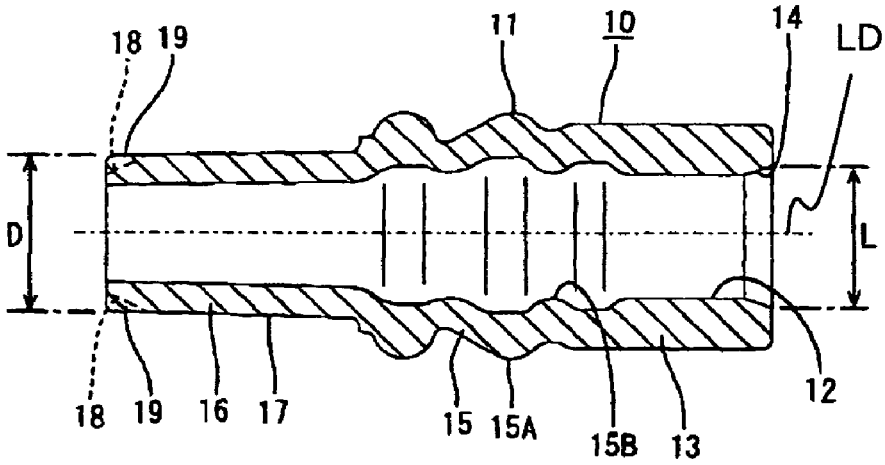
FIG. 2 is a section of the rubber plug.

A rubber plug according to the invention is identified by the numeral 10 in FIGS. 1 to 5. The rubber plug 10 can be fit on a wire 30 and fastened to a terminal fitting 20 by crimping, bending or folding an insulation barrel 21 of the terminal fitting 20. The assembly of the plug 10, the terminal fitting 20 and the wire 30 then can be inserted into a cavity of a housing of an unillustrated watertight connector to seal a clearance between the wire 30 and the cavity in a watertight manner. The leading end of the wire 30 along the inserting direction ID is referred to below as the front.

The terminal fitting 20 has an insulation barrel 21, a wire barrel 22, and a connecting portion (not shown) in this order from left side toward right side in FIG. 1. The wire barrel 22 has two projecting pieces 23 that can be crimped, bent or folded around a core 31 of the wire 30 located therebetween. Similarly, the insulation barrel 21 has two crimping pieces 24 that can be crimped, bent or folded around the rubber plug 10 fit on the wire 30. The connecting portion (not shown) is connectable with a mating terminal fitting.

The rubber plug 10 has a main body 11 made of a resilient material, preferably of silicon rubber, and a wire insertion hole 12 penetrates the main body 11 substantially along its longitudinal center.

A substantially thick cylindrical trunk 13 is provided at the rear end of the main body 11. A wire-introducing opening 14 is formed in the rear end surface of the trunk 13 and widens towards the rear for guiding the wire 30. The inner diameter of the wire insertion hole 12 in the trunk 13 substantially equals the outer diameter of the wire 30 inserted therein. However, the trunk 13 may have one or more inwardly projecting lips for contacting the outer surface of the wire 30 to provide a suitable sealing therebetween. The outer circumferential surface of the trunk 13 can closely contact the inner wall of the cavity by inserting the rubber plug 10 into the cavity of the housing.

A lip portion 15 is provided before the trunk 13 of the main body 11 and has substantially the same thickness as the trunk 13. Outer lips 15A are provided on the outer circumferential surface of the lip portion 15 and inner lips 15B are provided on the inner circumferential surface of the lip portion 15. The outer and inner lips 15A, 15B are displaced alternatively along longitudinal direction. The inner lips 15B can closely contact the wire 30, whereas the outer lips 15A can closely contact the inner wall of the cavity of the housing.

A fixing portion 16 is provided before the lip portion 15 of the main body 11 and is thinner than the lip portion 15 and the trunk 13. The outer circumferential surface of the fixing portion 16 defines a fastening portion 17 and the insulation barrel 21 of the terminal fitting 20 can be crimped, bent or folded into connection with the fastening portion 17.

Figure 3:
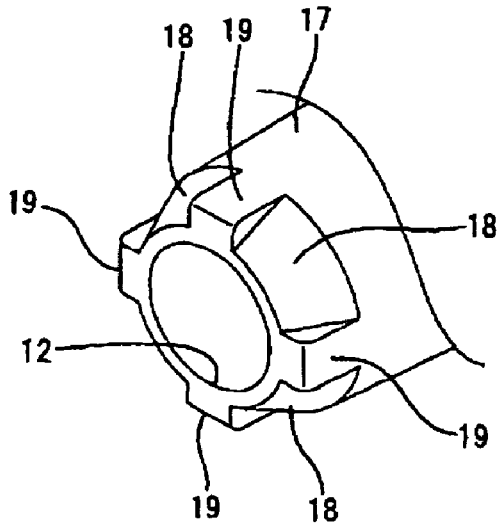
FIG. 3 is a perspective view showing an essential portion of the rubber plug.

As shown in FIG. 3, a tapered portion 18 narrows towards the front at a part of the outer circumferential surface of the main body 11 closer to the front end than the fastening portion 17. Protrusions 19 project radially out from the tapered portion 18 at the front end of the rubber plug 10 and are circumferentially spaced at substantially equal intervals (e.g. of about 90°). The protrusions 19 have an outer surface inclined to the longitudinal direction LD by an angle smaller than the angle of inclination of the tapered portion 18. The protrusions 19 are substantially parallel to the longitudinal direction of the tapered portion 18 and are substantially flush and continuous with the fastening portion 17 of the main body 11. Thus, radially outer surfaces of the protrusions 19 are inclined less to the longitudinal direction LD than the tapered portion 18. Moreover, the protrusions 19 may be set to project radially with respect to the longitudinal center by the same amount or a different amount.

The front-end surface, including the protrusions 19, defines a maximum outer diameter D that exceeds the inner diameter L of the wire-introducing opening 14 (see FIG. 2) and substantially equals the minimum outer diameter of the fastening portion 17. In this regard, the maximum outer diameter D is a distance between vertices of opposed protrusions 19 that have the longitudinal center therebetween. The maximum outer diameter D also can be the diameter of the imaginary circle that is generated about the longitudinal center and that circumscribes the outermost fastening portions 17. The inner diameter L of the wire-introducing opening 14 is a diameter of an opening of the wire introducing opening 14 in the rear end surface of the trunk 13. The minimum outer diameter of the fastening portion 17 is an outer diameter of the fastening portion 17 at the front edge.

An end portion of the wire 30 is stripped to expose the core 31, and this wire 30 is inserted in the inserting direction ID through the wire-introducing opening 14 and into the wire insertion hole 12 of the main body 11. The wire-introducing portion 14 is tapered inwardly to guide the insertion of the wire 30. The assembly of the main body 11 and the wire 30 then is placed on the terminal fitting 20 so that the fastening portion 17 of the main body 11 aligns with the insulation barrel 21 of the terminal fitting 20 and so that the exposed core 31 of the wire 30 aligns with the wire barrel 22 of the terminal fitting 20. The wire barrel 22 then is crimped, bent or folded into connection with the exposed core 31 of the wire 30 and the insulation barrel 21 is crimped, bent or folded into connection with the fastening portion 17 of the main body 11 to fasten the rubber plug 10 to the wire 30. The assembly of the wire 30, the terminal fitting 20 and the rubber plug 10 then is inserted into the cavity of the housing to bring the outer lips 15*a* and the trunk 13 of the main body 11 into close contact with the inner wall of the cavity to hold the cavity watertight.

Part of the main body 11 before the fastening portion 17 may warp when the insulation barrel 21 is crimped into connection with the fastening portion 17 of the main body 11. However, the tapered portion 18 suppresses the warping and prevents the warped part from being turned up sufficiently to catch the inner wall of the cavity during insertion of the rubber plug 10 into the cavity of the connector housing. The maximum outer diameter D of the front-end surface including the protrusions 19 substantially equals to the minimum outer diameter of the fastening portion 17. Thus, the presence of the protrusions 19 will not hinder the insertion into the cavity even if the tapered portion 18 corresponding to the protrusions 19 warps.

The protrusions 19 are arranged circumferentially at substantially equal intervals (e.g. of about 90°). Thus, the entire front end of the main portion 11 receives a uniform elastic stress. Accordingly, there is no likelihood that only a part of the front end of the main body 11 will resiliently deform a large amount due to interference between the front end of the main body 11 and the opening edge or the inner wall of the cavity during insertion into the cavity. As a result, better insertion stability into the cavity can be attained.

Figure 4:
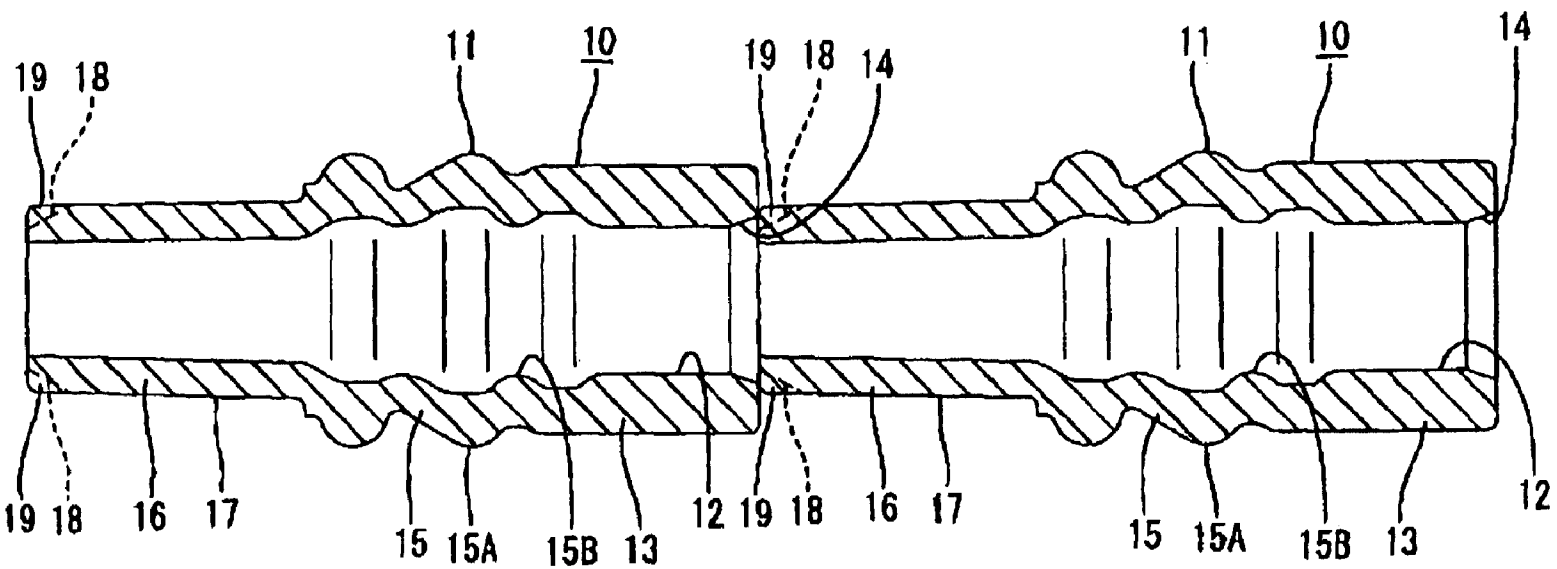
FIG. 4 is a section showing a state where the coupling of front and rear rubber plugs is prevented.
Figure 5:
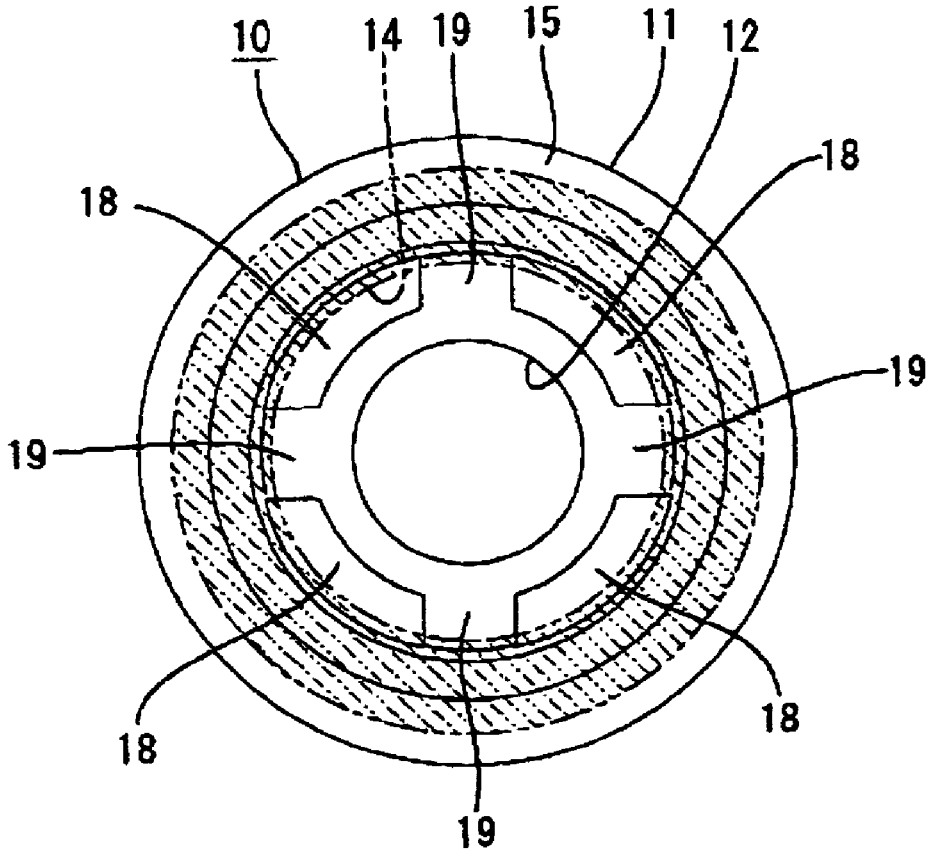
FIG. 5 is a front view of the rubber plug.
Figure 6:
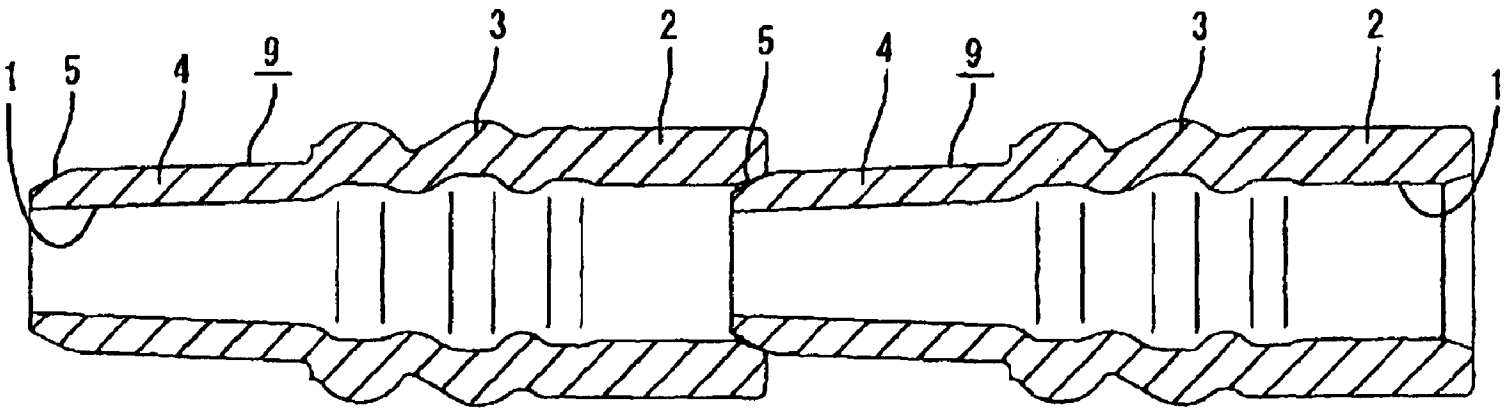
FIG. 6 PRIOR ART
FIG. 6 is a section showing a state where front and rear rubber plugs according to prior art are coupled.

The rubber plugs 10 are thrown into an unillustrated parts feeder prior to insertion of the wires 30 into the main bodies 11 and typically are conveyed in a straight line e.g. by vibration. Thus, the rubber plugs 10 push each other from the front and back, and the front end of one rubber plug 10 can be urged towards the wire insertion hole 12 of another rubber plug 10. However, the maximum outer diameter D of the front end, including the protrusions 19, exceeds the inner diameter L of the wire insertion hole 14. Thus, as shown in FIG. 4, the protrusions 19 on one rubber plug 10 interfere with the opening edge of the wire insertion opening 14 in the rear end surface of the preceding rubber plug 10. Therefore, the front end of each rubber plug 10 is prevented from entering the wire insertion hole 12 of any other rubber plug 10. As a result, the rubber plugs 10 are prevented from being coupled together and can be conveyed in proper alignment in the parts feeder.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Several protrusions are on the front end of the rubber plug main body in the foregoing embodiment. However, only one protrusion may be provided according to the present invention.

Four protrusions are provided at intervals of 90° in this embodiment. However, the protrusions can be provided in different numbers and at different intervals according to the present invention.

The protrusions project radially out from the tapered portion in the foregoing embodiment. However, they may project radially along the front-end surface of the main body according to the present invention.

The tapered portion is inclined at a specified angle in the foregoing embodiment. However, the tapered portion can have a curved or other narrowing configuration according to the invention.

The maximum outer diameter of the front-end surface, including the protrusions, may be smaller than the minimum outer diameter of the fastening portion. Thus, the tapered portion is even less likely to warp as the insulation barrel is crimped, and any warped portion is less likely to catch the inner wall of the cavity. Alternatively, the maximum outer diameter of the front-end surface including the protrusions may exceed the minimum outer diameter of the fastening portion if catching of the rubber plug during insertion into the cavity is not perceived as a problem.

What is claimed is:

1. A resilient plug having a main body with opposite front and rear ends, a wire insertion hole penetrating the main body from the front end to the rear end along a longitudinal center, a wire introducing opening formed at the rear end of the main body and having an inner diameter, the wire introducing opening communicating with the wire insertion hole for inserting a wire into the wire insertion hole, a tapered portion adjacent the front end and being narrowed towards the front end to define a minimum outside diameter that is less than the inner diameter of the wire introducing opening at the rear end of the main body, a plurality of protrusions projecting out from the tapered portion to the front end of the main body and being circumferentially spaced at substantially even intervals, the front end of the main body at the protrusions defining a maximum outer diameter that exceeds the inner diameter of the wire introducing opening, and a substantially cylindrical or forwardly tapered fastening portion formed on an outer circumferential surface of the main body rearward of the tapered portion and dimensioned to be fastened to an insulation barrel of a terminal fitting.

2. The plug of claim 1, wherein the maximum outer diameter of the front end at the protrusions is no greater than a minimum outer diameter of the fastening portion.

3. The plug of claim 1, wherein radially outer surfaces of the protrusions incline less towards the front than the tapered portion.

4. The plug of claim 1, wherein the main body is made of silicon rubber.

5. The plug of claim 1, wherein the wire-introducing opening is converges inwardly towards the front.

6. The plug of claim 1, wherein the main body comprises a lip portion having at least one outer lip on an outer circumferential surface of the lip portion and at least one inner lip on an inner circumferential surface of the lip portion.

7. A resilient plug having opposite front and rear ends, a wire insertion hole penetrating the plug from the front end to the rear end along a longitudinal center, the insertion hole having an inside diameter adjacent the rear end, the plug having a fastening portion between the front and rear ends, the fastening portion having a substantially cylindrical or forwardly tapered conical outer surface, a plurality of circumferentially spaced tapered portions converging forwardly from the fastening portion to the front end to define a minimum outside diameter at the front end that is less than the inside diameter of the insertion hole adjacent the rear end of the resilient plug, and a plurality of circumferentially spaced protrusions extending forwardly from the fastening portion to the front end, the protrusions projecting out at locations between the respective tapered portions, the front end of the main body at the protrusions defining a maximum outer diameter that exceeds the inner diameter of the wire insertion hole at the rear end of the plug.

8. The plug of claim 7 further comprising a trunk adjacent the rear end, the trunk having a substantially cylindrical outer surface, a ribbed portion forward of the trunk and formed with outer and inner circumferentially extending ribs.

9. The plug of claim 7, wherein the maximum outer diameter of the front end at the protrusions is no greater than a minimum outer diameter of the fastening portion.

10. The plug of claim 9, wherein radially outer surfaces of the protrusions incline less towards the front than the tapered portion.

11. A terminated wire assembly, comprising:

a wire having an end, a conductive core exposed at the end and an insulating coating covering the core at locations spaced from the end;

a resilient plug having opposite front and rear ends, a wire insertion hole penetrating the plug from the front end to the rear end along a longitudinal center, portions of the wire insertion hole at the rear end defining an inner diameter, the wire being inserted through the insertion hole so that exposed portions of the core project forward of the front end of the plug and so that portions of the insulating coating in the insertion hole are engaged resiliently by the plug, the plug having a fastening portion between the front and rear ends, the fastening portion having a substantially cylindrical or forwardly tapered conical outer surface, a plurality of circumferentially spaced tapered portions converging forwardly from the fastening portion to the front end, the tapered portions defining a minimum outside diameter at the front end of the resilient plug that is less than the inner diameter of the wire insertion hole at the rear end of the resilient plug and a plurality of circumferentially spaced protrusions extending forwardly from the fastening portion to the front end, the protrusions projecting out at locations between the respective tapered portions and defining a maximum outer diameter that exceeds the inner diameter of the wire insertion hole at the rear end of the plug; and a terminal fitting having an insulation barrel crimped into engagement with the fastening portion and a wire barrel crimped into engagement with the exposed portion of the core, whereby the tapered portions suppress warping at the front end of the plug in response to crimping of the insulation barrel into engagement with the fastening portion.

12. The assembly of claim 11, wherein the plug has a trunk adjacent the rear end, the trunk having a substantially cylindrical outer surface, a ribbed portion forward of the trunk and formed with outer and inner circumferentially extending ribs.

13. The assembly of claim 11, wherein the maximum outer diameter of the front end at the protrusions is no greater than a minimum outer diameter of the fastening portion.

14. The assembly of claim 13, wherein radially outer surfaces of the protrusions incline less towards the front than the tapered portion.

* * * * *